US005904060A

United States Patent [19]

Kanemitsu et al.

[11] Patent Number: 5,904,060

[45] Date of Patent: May 18, 1999

[54] SHEET METAL MEMBER HAVING A PERIPHERAL WALL AND METHOD OF THICKENING THE PERIPHERAL WALL THEREOF

[75] Inventors: Toshiaki Kanemitsu, Kobe; Shuji Kanemitsu, Kakogawa; Hironori Nishioka, Kobe, all of Japan

[73] Assignee: Kabushiki Kaisha Kanemitsu, Hyogo, Japan

[21] Appl. No.: 09/011,466

[22] PCT Filed: Jul. 10, 1996

[86] PCT No.: PCT/JP96/01927

§ 371 Date: Mar. 17, 1998

§ 102(e) Date: Mar. 17, 1998

[87] PCT Pub. No.: WO98/01246

PCT Pub. Date: Jan. 15, 1998

[51] Int. Cl.[6] ..... B21H 1/04

[52] U.S. Cl. ..... 72/110; 29/893.32

[58] Field of Search ..... 72/111, 110; 29/893.32

[56] References Cited

U.S. PATENT DOCUMENTS 5,152,061 10/1992 Himmeroeder ..... 29/893.32

5,699,689 12/1997 Yamanaka ..... 72/110

FOREIGN PATENT DOCUMENTS 2045665 11/1980 United Kingdom ..... 29/893.32

*Primary Examiner*—Lowell A. Larson

*Attorney, Agent, or Firm*—Jones, Tullar & Cooper, P.C.

[57] ABSTRACT

A sheet metal member thickening method according to the present invention comprises the steps of rotating a disc-shaped sheet metal member held between rotating dies, and pressing a first forming roller and a second forming roller subsequently against a periphery thereof while rotating it, thereby forming a base plate and a thickened peripheral wall thereof. A first forming step comprises plural small steps, including a previous small step in the first forming step and a post small step following the previous one. Between the previous small step and the post small step, a radius of curvature of the annular bottom surface of the forming surface of the first forming roller is greater than that of the annular bottom surface of the forming surface of the first forming roller employed in the previous small step, and an opening angle between a pair of annular forming surfaces of the forming surface of the first forming roller employed in the post steps is smaller than that between the pair of annular forming surfaces of the forming surface of the first forming roller employed in the previous small step.

7 Claims, 12 Drawing Sheets

Fig. 16

| | First Forming Step | | | | | Second Forming Step |
|---|---|---|---|---|---|---|
| Small Step | 1st | 2nd | 3rd | 4th | 5th | Arc being Substantially Right Angle |
| R n (mm) | 3 | 4 | 5 | 6 | 7.5 | |
| θ n (°) | 22 | 22 | 22 | 20 | 17 | θ 3 = 13 |
| a n (°) | 17 | 17 | 17 | 15 | 12 | a 3 = 5 |
| b n (°) | 5 | 5 | 5 | 5 | 5 | b 3 = 8 |

SHEET METAL MEMBER HAVING A PERIPHERAL WALL AND METHOD OF THICKENING THE PERIPHERAL WALL THEREOF

BACKGROUND OF THE INVENTION

1. Field of the Invention

The present invention relates to a sheet metal member integrally having a peripheral wall surrounding a base plate, such as in piston components and a drive plate employed in the automatic transmission of an automobile, and a method of thickening a peripheral wall thereof. Specifically, the present invention relates to the employment of a thin disc-shaped sheet metal material, thereby forming a peripheral wall whose thickness is several times the thickness of the disc-shaped sheet metal material.

2. Description of the Prior Art

Conventionally, a technique for roll forming a sheet metal member integrated with a peripheral wall which is slightly thicker than a base plate, and surrounding the base plate by means of a forming roller, is often employed. However, it has been impossible to provide a method of thickening the peripheral wall of the sheet metal member so as to be several or more times the thickness of the base plate by employing the conventional roll forming method, and it has not been thought of to form the sheet metal member having a peripheral wall whose thickness reaches a value which is several times more than that of the base plate.

Therefore, in the sheet metal member integrally having a peripheral wall surrounding the base plate, such as in piston components, the sheet metal member having the peripheral wall whose thickness is increased several times the thickness of the base plate is conventionally formed by a cutting process. However, the yield on material in the cutting process is low, thereby causing an uneconomical state.

The present invention has been developed in view of the above mentioned circumstances. It is an object of the present invention to provide a sheet metal member integrally having a peripheral wall, surrounding the base plate, whose thickness is increased so as to be several times the thickness of the base plate.

It is another object of the present invention to provide a method of thickening a peripheral wall of the sheet metal member, enabling the thickness of the peripheral wall to be increased so that it is several times the thickness of the base plate.

SUMMARY OF THE INVENTION

In order to achieve the above objects, a sheet metal member having a peripheral wall according to the present invention comprises a circular base plate, and a peripheral wall protruding axially from an outer periphery of the circular base plate to one side, the peripheral wall being integrated with the circular base plate, wherein an axial thickness of the peripheral wall is increased so as to be 4 or more times the thickness of the base plate, and a radial thickness of the peripheral wall is increased so as to be 2 or more times the thickness of the base plate.

The sheet metal member having the peripheral wall according to the present invention is thickened by the success of the thickening method mentioned below, so that the axial thickness of the peripheral wall is 4 or more times the thickness of the base plate and the radial thickness thereof is 2 or more times that of the base plate. Then, an outer surface of the peripheral wall is provided with annular grooves to be concentric with the peripheral wall, or a boss is disposed on a center of the base plate so as to be integrated therewith, thereby enabling the sheet metal member to be employed as in piston components. Moreover, the base plate is thin, and the peripheral wall is thickened. Accordingly, the cost of the material is low.

A method of thickening a peripheral wall of a sheet metal member according to the present invention comprises a first forming step having plural small steps, and each small step comprises a series of steps of holding pressingly a disc-shaped sheet metal material in an interposed state, between a first rotating die and a second rotating die, making the disc-shaped sheet metal material rotate with the first rotating die and the second rotating die, pressing a first forming roller having a first groove-shape forming surface wherein a pair of annular surfaces which widen outwardly, are connected via a sectional-curved annular bottom surface, in a radially inward direction against an outer periphery of a projection of the disc-shaped metal sheet projecting outwardly from the interposed portion, thickening the projection in an axial direction and a radial direction, and shaping the projection so as to fit in the groove-shaped forming surface of the first forming roller while thickening it, whereby the interposed portion is a base plate and the projection is a peripheral wall protruding axially from the outer periphery of the base plate to one side;

wherein, the first forming step is divided into the plural small steps, and, as the relation between a previous small step in the first forming step and a post small step following the previous one, a radius of curvature of the annular bottom surface of the first forming roller employed in the post small step is greater than that of the first forming roller employed in the previous small step, and an opening angle made between a pair of annular surfaces of the first forming roller employed in the post small step is smaller than that between a pair of annular surfaces of the first forming roller employed in the previous small step and a depth of the first groove-shaped forming surface of the first forming roller employed in the post small step is less than that of the first groove-shape forming surface of the first forming roller employed in the previous small step.

By the method, a sheet metal member is obtained wherein the axial thickness of the sheet metal member or the peripheral wall is increased so as to be 4 or more times the thickness of the base plate, and the radial thickness thereof is increased so as to be 2 or more times the thickness of the base plate.

The method of thickening a peripheral wall of a sheet metal member according to the present invention further comprises a second forming step for forming the outer peripheral surface of the peripheral wall in a cylindrical shape after conducting the first forming step, of pressing a second forming roller having a second groove-shaped forming surface including a pair of annular surfaces widening outwardly and an annular bottom surface being axially flat, for connecting the annular surfaces, against the peripheral wall obtained by the first forming step, thereby shaping the outer surface of the peripheral wall so as to fit in the second groove-shaped forming surface of the second forming roller.

In the method of thickening a peripheral wall of a sheet metal member according to the present invention, preferably, an initial small step among the plural small steps comprises a series of steps of pressing one annular surface in the first groove-shaped forming surface of the first forming roller against the outer periphery of the projection of the disc-shaped sheet metal material, bending the projection into a state according to which the projection widens outwardly when approaching an end, thickening the projection axially and radially, and shaping the surface of the projection so as to fit in the first groove-shaped forming surface of the first forming roller, while thickening it.

In the present method, a radius of curvature of the annular bottom surface of the first forming roller employed in the initial small step is shorter than measurements of 1.5 times the thickness of the interposed portion of the disc-shaped sheet metal material, and preferably, it is shorter than a thickness of the interposed portion of the disc-shaped sheet metal material.

By the method, the outer peripheral surface of the thickened peripheral wall is a cylindrical surface, which is a axially flat, thereby obtaining a useful sheet metal member suitable for piston components.

In accordance with the present method, preferably, in holding pressingly the disc-shaped sheet metal material having annular steps disposed on each radial predetermined portion between the first rotating die and the second rotating die, annular steps disposed on the first rotating die and the second rotating die are radially engaged with the steps of the disc-shaped sheet metal material, thereby interposing the disc-shaped sheet metal material.

Consequently, the base plate is thinned and the peripheral wall is thickened by a holding force or the like between the first rotating die and the second rotating die, thereby causing a flow creating a thickness which prevents upheaving owing to building of the thickness of the root of the peripheral wall.

BRIEF DESCRIPTION OF THE DRAWINGS

FIG. 16 is a table illustrating measurements of a first annular forming surface of the first forming roller.

DETAILED DESCRIPTION OF THE PREFERRED EMBODIMENTS

Figure 1:
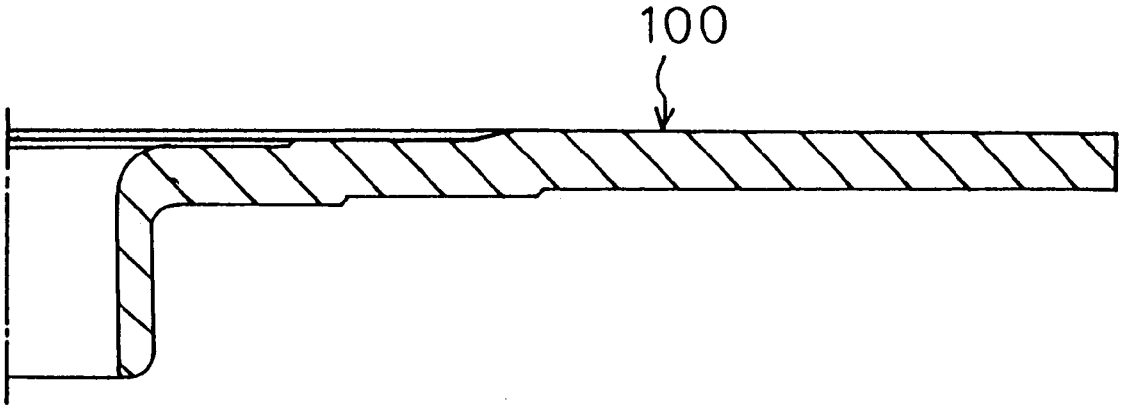
FIG. 1 is a partly sectional view of a disc-shaped sheet metal member according to the present invention.
Figure 2A:
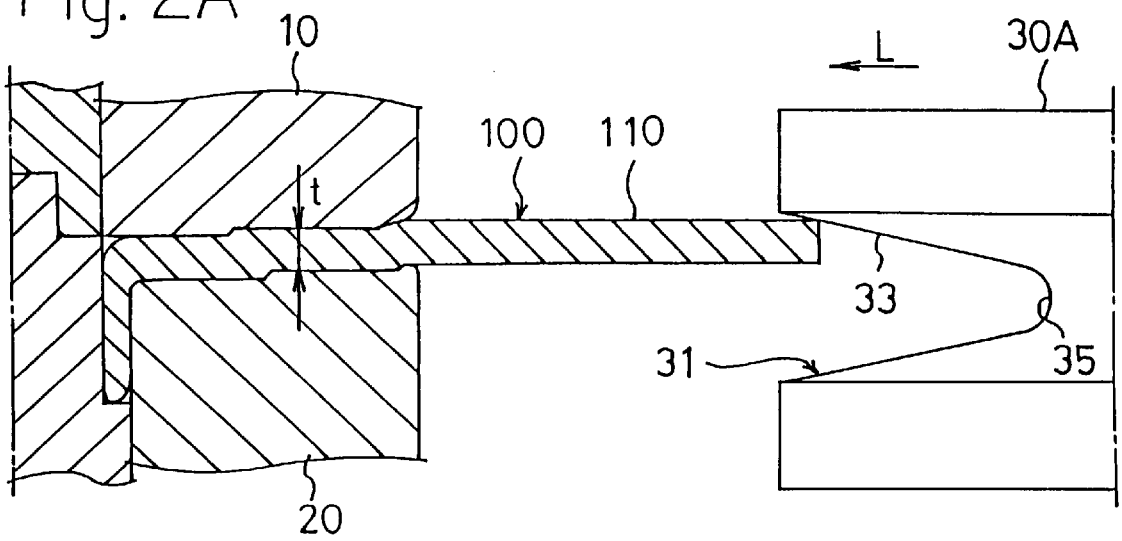
FIG. 2A is a view illustrating an initial stage of a small step included in a first forming step.
Figure 2B:
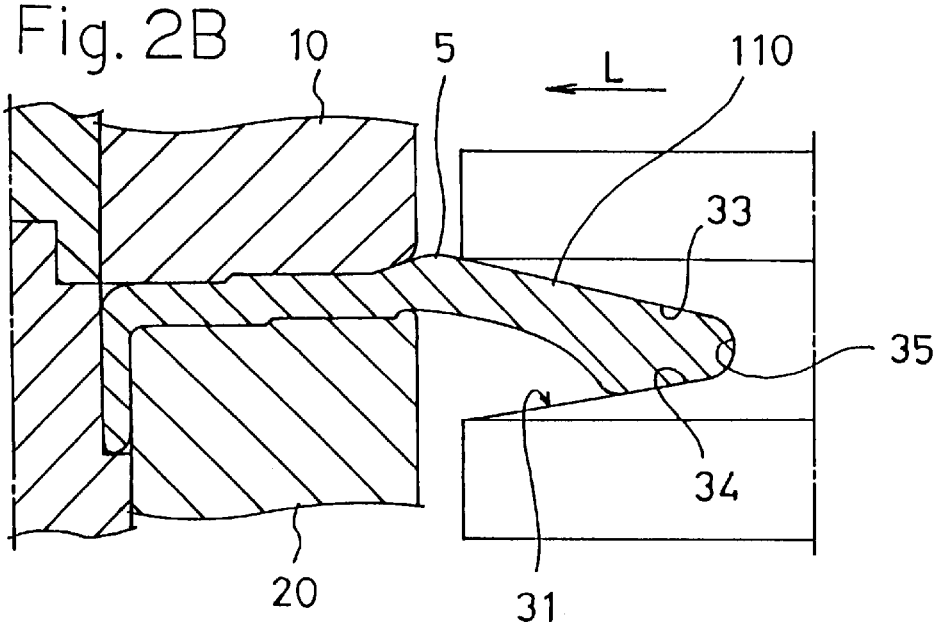
FIG. 2B is a view illustrating a final stage of the small step included in the first forming step.
Figure 3A:
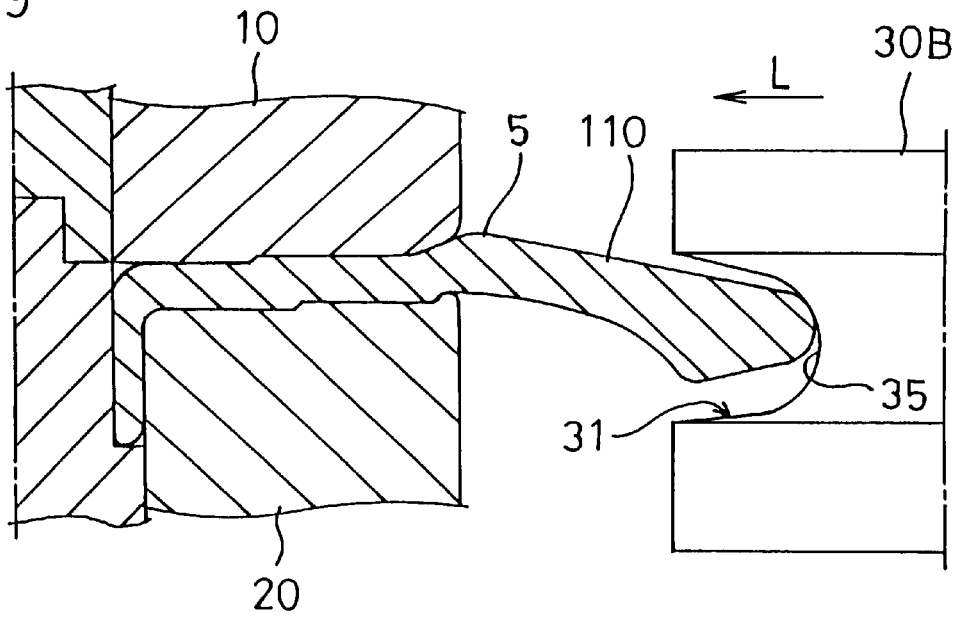
FIG. 3A is a view illustrating an initial stage of another small step included in the first forming step.
Figure 3B:
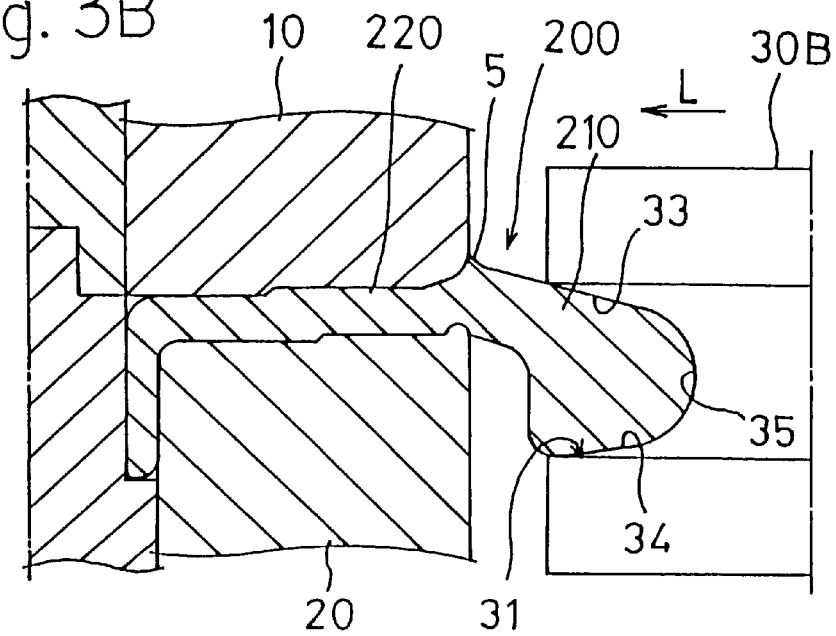
FIG. 3B is a view illustrating a final stage of the above small step included in the first forming step.
Figure 4A:
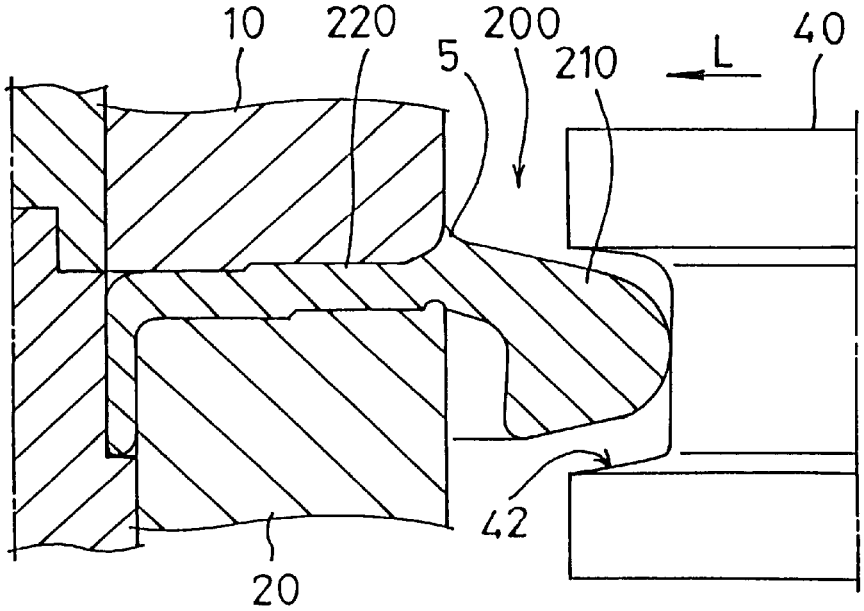
FIG. 4A is view illustrating an initial stage of a second forming step.
Figure 4B:
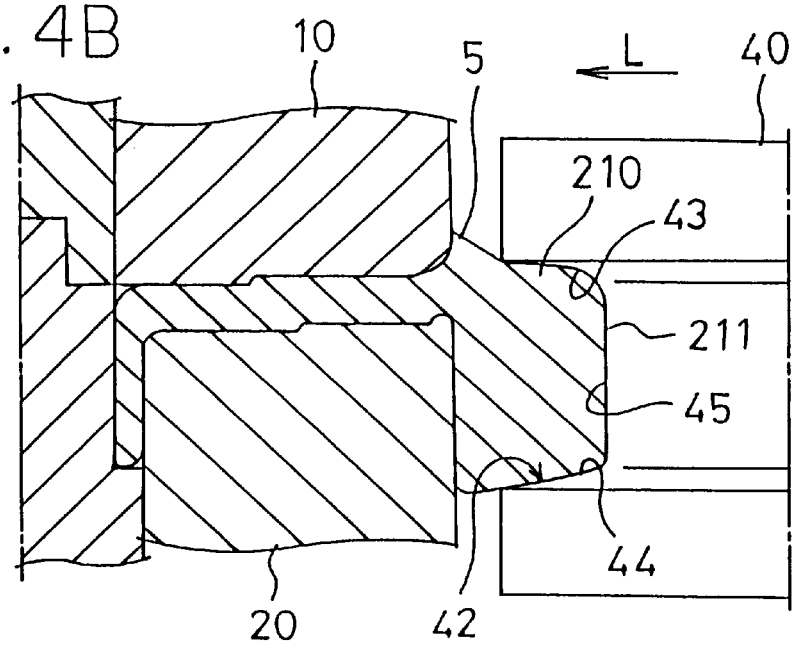
FIG. 4B is a view illustrating a final stage of the second forming step.

A method of thickening a peripheral wall of a sheet metal member shown in the preferred embodiments basically comprises a first forming step including a series of steps, shown in FIGS. 2A, 2B, 3A and 3B, of pressingly holding a disc-shaped sheet metal member 100 shown in FIG. 1 in an interposed state, between a first rotating die 10 and a second rotating die 20, and making the disc-shaped sheet metal member 100 rotate with the first rotating die 10 and the second rotating die 20 while pressing a first groove-shaped forming surface 31 of a first forming roller 30A in a radially inward direction against an outer periphery of a projection 110 of the disc-shaped sheet metal member 100 projecting outwardly from the pressingly interposed portion; and then a second forming step shown in FIGS. 4A and 4B according to which an outer peripheral surface of a thickened peripheral wall 210 of a sheet metal member 200 obtained by the first forming step so as to be an axially flat cylindrical surface.

Figure 10:
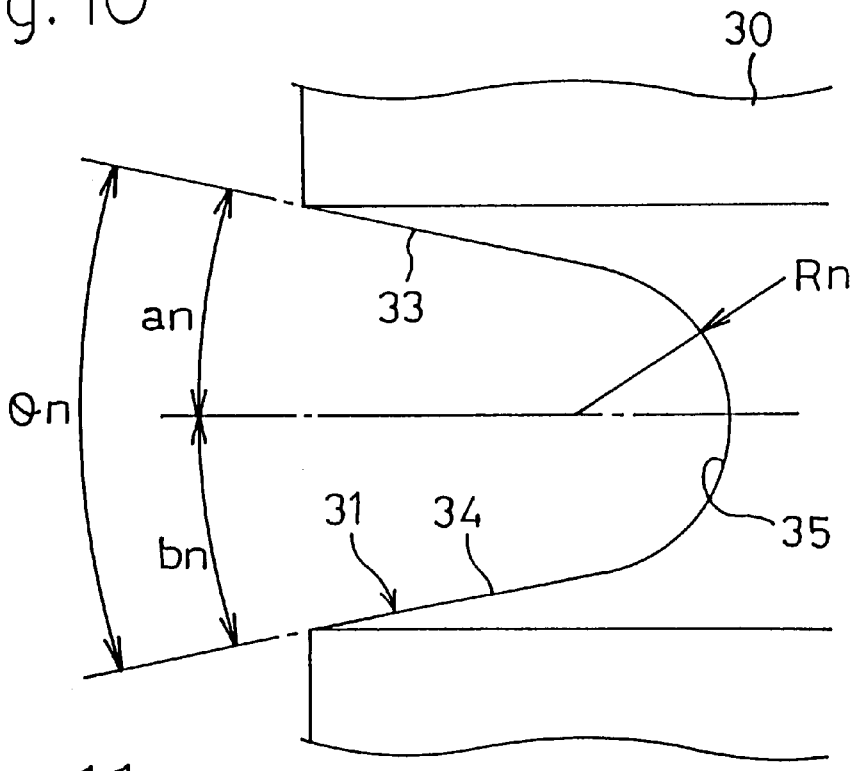
FIG. 10 is a view generally illustrating the first forming roller employed in the first forming step.

FIG. 10 illustrates a general shape of the first forming roller 30 employed in the first forming step. As shown in the same figure, the first forming roller 30 has a first groove-shaped forming surface 31 smoothly connected to a pair of the annular surfaces 33, 34 inclined in a state of widening outwardly via a sectional-curved annular bottom surface 35. The first forming step is divided into plural small steps, and the every small step employs individually a different first forming roller 30 having a different radius of curvature Rn of the annular bottom surface 35 and an opening angle θ n between the pair of annular surfaces 33 and 34, different from those of other first forming rollers.

Figure 8:
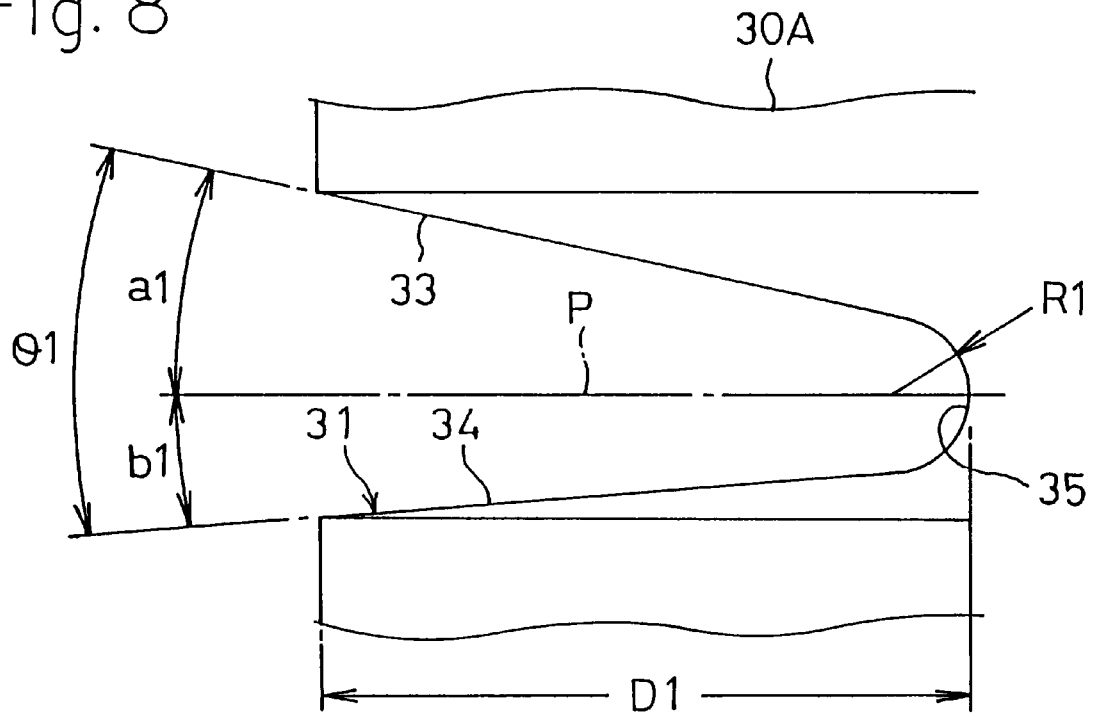
FIG. 8 is a view illustrating a first forming roller employed in the small step in FIGS. 2A and 2B.
Figure 9:
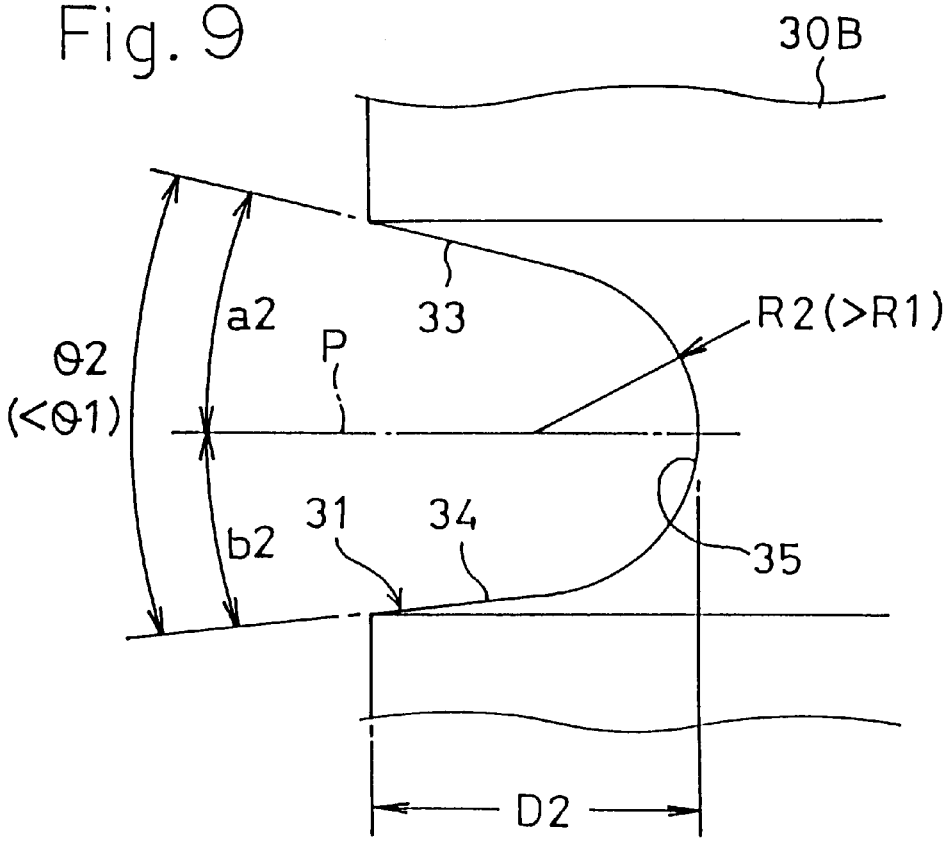
FIG. 9 is a view illustrating a first forming roller employed in the small step in FIGS. 3A and 3B.

In this embodiment, the first forming step is divided into two small steps, in a previous small step, a first forming roller 30A shown in FIG. 8 is employed and in a post small step following the previous small step, a first forming roller 30B shown in FIG. 9 is employed. Between these two kinds of first forming rollers 30A and 30B, a radius of curvature R2 of the annular bottom surface 35 of the first forming roller 30B employed in the post small step is larger than a radius of curvature R1 of the annular bottom surface 35 of the first forming roller 30A employed in the previous small step. Moreover, an opening angle θ 2 between the pair of annular surfaces 33, 34 of the first forming roller 30B employed in the post small step, is smaller than an opening angle θ 1 between the pair of annular surfaces 33 and 34 of the first forming roller 30A employed in the previous small step. Moreover, the first annular forming surface 31 of the first forming roller 30 B employed in the post small step has a groove depth D2, which is smaller than a groove depth D1 of the first annular forming surface 31 of the first forming roller 30A employed in the previous small step.

In the two small steps in the first forming step according to this embodiment, the first rotating die 10 and the second rotating die 20 are commonly employed in the previous small step as well as in the post small step.

As shown in FIGS. 2A, 2B, 3A and 3B, in the first forming step, the disc-shaped sheet metal member 100 is pressingly held between the first rotating die 10 and the second rotating die 20 in an interposed state, thereby preventing an interposed portion from transforming or making it difficult to cause transformation thereof. Either the first rotating die 10 or the second rotating die 20 is rotatively driven, thus rotating the disc-shaped sheet metal material 100 with the rotating dies 10 and 20.

In an initial stage of the previous small step shown in FIG. 2A, it is conducted to rotate the disc-shaped sheet metal member 100 as mentioned above, and pressing the rotatable first forming roller 30A in a radially inward direction against an outer periphery of the projection 110 of the disc-shaped sheet metal member 100 projecting outwardly from the interposed portion while pressing it, thereby allowing the disc-shaped sheet metal member 100 to rotate the first forming roller 30A. In the initial stage, as shown in FIG. 2A, when the annular surface 33 on one side in the first groove-shaped forming surface 31 of the first forming roller 30A is pressed in a radially inward direction against the outer periphery of the projection 110 of the disc-shaped sheet metal member 100, the projection 110 thereof is bent in a state according to which the projection widens as it approaches its end, with moving the first forming roller 30A to the left side L in the figure, before the outer periphery of the projection 110 reaches the annular bottom surface 35 of the first groove-shaped forming surface 31.

Figure 2C:
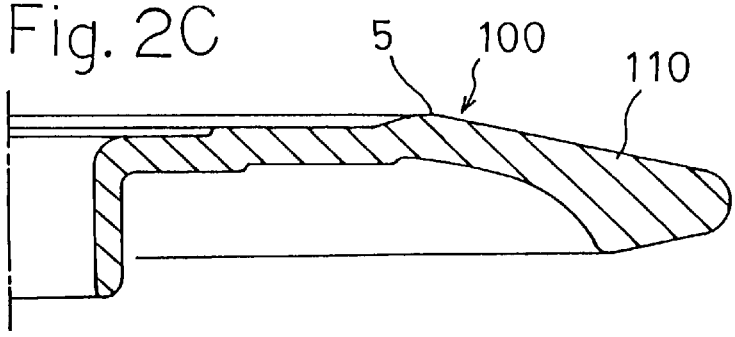
FIG. 2C is a partly sectional view of the disc-shaped sheet metal member obtained by the above small step in FIGS. 2A and 2B.

The first forming roller 30A is further moved to the left side L in the figure, whereby the projection 110 is gradually thickened axially and radially without its tip being curled, while shaping the projection 110 by the annular bottom surface 35 of the first groove-shaped forming surface 31 and the pair of annular surfaces 33 and 34. Thickening the projection 110 mentioned above is caused by a flow resulting in a thickness of the projection 110 generated by the pressure of the first forming roller 30A. The projection 110 of the disc-shaped sheet metal member 100 through the last stage in the previous small step, is shaped according to the first annular surface 31 of the first forming roller 30A employed in the small step, as shown in FIGS. 2B and 2C. A diameter of the projection 110 is smaller than that of the disc-shaped forming member 100 as shown in FIGS. 1 and 2A.

Figure 3C:
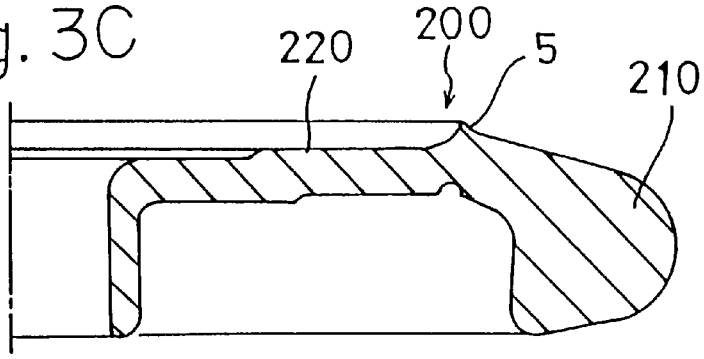
FIG. 3C is a partly sectional view of the sheet metal member obtained by the above small step in FIGS. 3A and 3B.

In an initial stage of the post small step in FIG. 3A, against the outer periphery of the projection 110 which is thickened and shaped so as to fit in the first annular forming surface 31 of the first forming roller 30A, via the previous small step, the rotatable first forming roller 30B is pressed in a radially inward direction, whereby the first forming roller 30B follows the disc-shaped sheet metal member 100 for rotating. In the initial stage, the outer periphery of the projection 110 touches the annular bottom surface 35 of the first annular forming surface 31. The first forming roller 30B is further moved to the left side L in the figure, whereby the projection 110 is shaped by the annular bottom surface 35 of the first groove-shaped forming surface 31 and the pair of annular surfaces 33 and 34, while it is gradually thickened axially and radially without curling the tip thereof. Thus, thickening the projection 110 is caused by the flow of material forming the thickness of the projection 110 generated by the pressure of the first forming roller 30B. The projection 110 of the disc-shaped sheet metal member 100 through a final stage in the post small step is shaped according to a shape of the first annular forming surface 31 of the first forming roller 30B employed in the small step, as shown in FIGS. 3B and 3C. Moreover, the diameter of the projection 110 is smaller than that of the disc-shaped forming member 100 as shown in FIGS. 2B and 2C.

By conducting the first forming step, a sheet metal member 200, as shown in FIG. 2C, wherein the interposed portion between the first rotating die 10 and the second rotating die 20 in the disc-shaped forming member 100 is a base plate 220, and the projection 110 is the peripheral wall 210 axially projecting from the outer periphery of the base plate 220 to one side, is obtained. In the sheet metal member 200, an outer peripheral surface of the peripheral wall 210 has a shape expanded while axially approaching the a center. The peripheral wall 210 of the sheet metal member 200 is processed by the second forming step.

Figure 11:
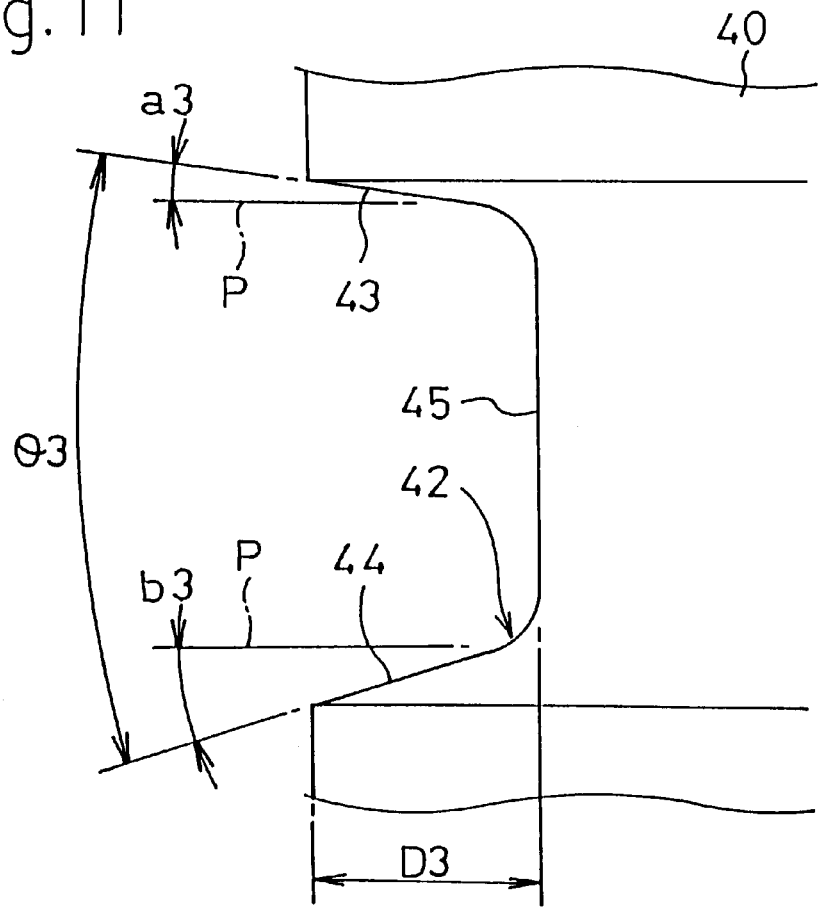
FIG. 11 is a view illustrating a second forming roller employed in the second forming step.

FIG. 11 illustrates the shape of a second forming roller 40 employed in the second forming step. As shown in the same figure, the second forming roller 40 includes a second groove-shaped forming surface 42 formed by a pair of annular surfaces 43 and 44 inclined so as to widen outwardly and an axially flat annular bottom surface 45 connecting the annular surfaces 43 and 44. The opening angle θ 3 between the pair of annular surfaces 43 and 44 of the second forming roller 40 is smaller than the respective opening angles θ 1 and θ 2 made between the pair of annular surfaces 33 and 34 of the each first forming roller 30A and 30B. Furthermore, a groove depth D3 of the second annular forming surface 42 is smaller than the groove depths D1 and D2 of the first annular forming surface 31 of each first forming roller 30A and 30B employed in the first forming step.

In the second forming step, the same first rotating die 10 and the second rotating die 20 that are employed in the first forming step are continuously employed. Accordingly, the base plate 220 of the sheet metal member 200 obtained by the first forming step is pressingly held between the first rotating die 10 and the second rotating die 20 in an interposed state, thereby preventing it from causing transformation thereof.

Figure 4C:
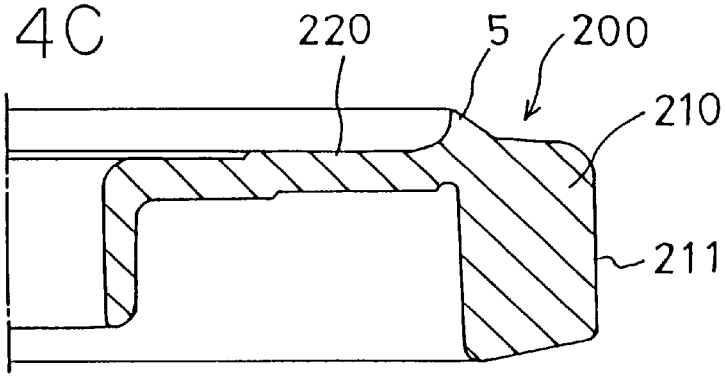
FIG. 4C is a partly sectional view of the sheet metal member obtained by the second forming step in FIGS. 4A and 4B.

In an initial stage of the second forming step as shown in FIG. 4A, while rotating the sheet metal member 200, the rotatable second forming roller 40 is pressed in a radially inward direction against the outer periphery of the peripheral wall 210 projecting outwardly, whereby the second forming roller 40 follows the sheet metal member 200 to rotate. The second forming roller 40 is further moved to the left side L in the figure, the peripheral wall 210 is shaped by the annular bottom surface 45 of the second groove-shaped forming surface 42 and the pair of annular surfaces 43 and 44. Thus, forming the peripheral wall 210 is caused by a flow of material forming a thickness of the peripheral wall 210 generated by the pressure of the second forming roller 40. The peripheral wall 210 of the sheet metal member 200 obtained by the second forming step is shaped so as to fit in the shape of the second groove-shaped forming surface 42 as shown in FIGS. 4B and 4C, with the result that the outer peripheral surface 211 is an axially flat cylindrical surface. Furthermore, the diameter of the peripheral wall 210 is smaller than that of the sheet metal member 200 obtained by the first forming step (see FIG. 3C).

In the method of thickening the peripheral wall of the sheet metal member as mentioned above, preferably, the radius of curvature R1 of the annular bottom surface 35 of the first forming roller 30A employed in the initial small step described in FIGS. 2A and 2B, is 1.5 or less times the thickness t of the interposed portion of the disc-shaped sheet metal member 100, and especially preferably, the radius of curvature R1 thereof is shorter than the thickness t thereof. This is the reason why the measurements of the radius of the curvature R1 is too large in view of the thickness t of the disc-shaped sheet metal member 100, thereby increasing the possibility of curling the tip of the member at the outer periphery of the disc-shaped sheet metal member 100, with pressing the first annular forming surface 31 of the first forming roller 30A against the outer periphery of the disc-shaped sheet metal member 100. As mentioned above, in the initial small step of the first forming step, the first forming roller 30A having the radius of curvature R1 being shorter than the thickness t of the disc-shaped sheet metal member 100, is employed with the result that there is no possibility of curling the tip of the member at the outer periphery of the disc-shaped sheet metal material 100.

The above thickening method is to increase the axial thickness and the radial thickness of the peripheral wall 210 in the sheet metal member 200 so as to be several or more times a thickness of the base plate 220. Through the first forming step and the second forming step, the disc-shaped sheet metal member 100 and the sheet metal member 200 are held between the first rotating die 10 and the second rotating die 20, by a great hydraulic force. Therefore, there is a possibility wherein the flow of material creating the thickness is caused at the each interposed portion of the disc-shaped sheet metal member 100 and sheet metal member 200, thereby thinning the interposed portion. In case of decreasing the thickness, an excess thickness is bulged on a portion where the flow of the thickness is not regulated, that is the portion between the first rotating die 10 and the first forming roller 30A, is bulged as shown in FIG. 2B, so as to generate a bulged portion 5, with the result that a state, wherein the bulged portion 5 is gradually acuminated to grow, is remarkably generated. When, in the sheet metal member 200 as a final product, the above bulged portion 5 emerges, a useless portion in the material corresponding to the bulged portion is generated. Moreover, the above bulged portion 5 is generated, thereby making it impossible to conduct the formation by the second forming roller 40 effectively. Consequently, the peripheral wall may lack a corner thereof.

Figure 12:
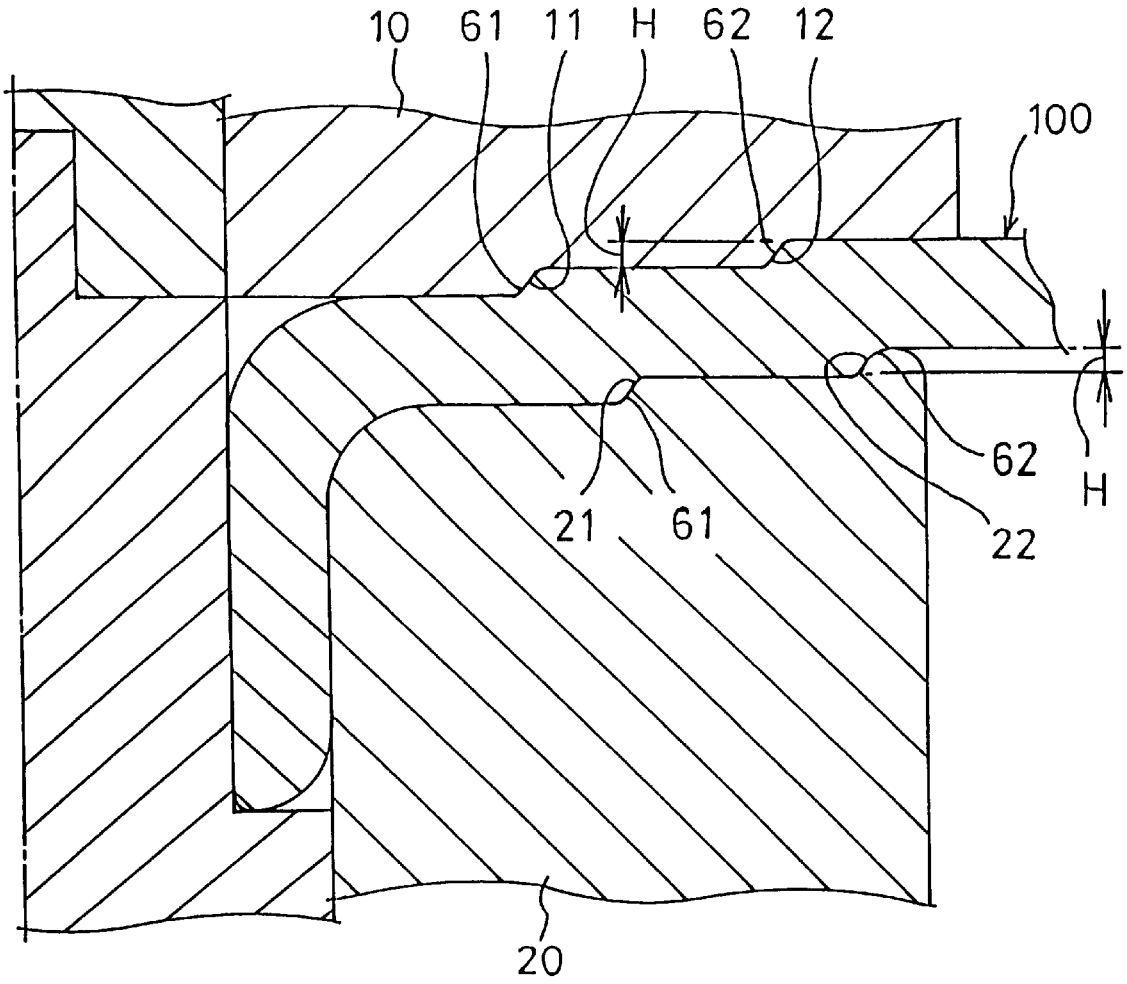
FIG. 12 is a view illustrating the effects of details in the small steps included in the first forming step.

Then, in order to restrict the bulged portion 5 to the minimum degree, the following countermeasure is taken. As shown in FIG. 12, on both the top surface and back surface of 2 portions in a radial direction of the disc-shaped sheet metal member 100, annular steps 61 and 62 are formed by pressing or the like, the disc-shaped sheet metal member 100 is pressingly held between the first rotating die 10 and the second rotating die 20, and annular steps 11, 12, 21, and 22 disposed on the first rotating die 10 and the second rotating die 20 are radially engaged with the steps 61 and 62 of the disc-shaped sheet metal member 100. This results in the bulged portion 5 produced in the post sheet metal member 200 obtained by the first forming step and the second forming step, not being not so large, and furthermore, of lacking a corner of the peripheral wall 210 does not occur. Presumably, the results may be owing to a state wherein the flow of material produces a thickness of the interposed portion is restricted by the steps 11 and 12 of the first rotating die 10 and the steps 21 and 22 of the second rotating die 20. Even a step difference H between the steps 61 and 62 of substantially 0.1 mm, is effective enough. As shown in the figure, the two steps of the steps 61 and 62 are respectively disposed inside and outside the disc-shaped sheet metal member 100, however, a single step or three or more steps may be disposed. Additionally, it is proved that, as the number of steps is increased, a remarkable effect can be obtained.

Figure 6:
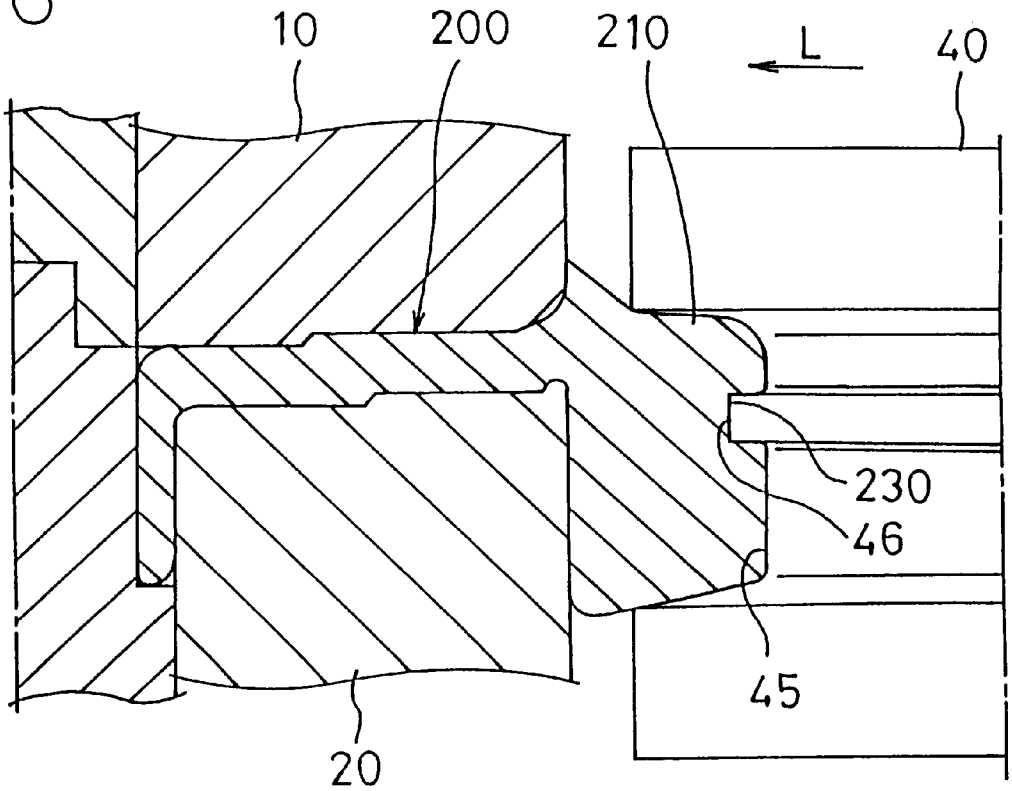
FIG. 6 is a view illustrating a final stage of another second forming step.

FIG. 6 illustrates a method of forming an annular groove 230 concentrically with the peripheral wall 210, at an outer surface of the peripheral wall 210 at the same time while conducting the second forming step.

In the second forming roller 40 employed in the above method, the annular bottom surface 45 of the second groove-shape forming surface 42 of the second forming roller 40, as shown in FIG. 11, is annularly provided with a protrusion 46. By employing the second forming roller 40, the second forming step illustrated in FIGS. 4A and 4B is conducted at the same time while the annular groove 230 concentrically with the peripheral wall 210 is disposed.

Figure 5:
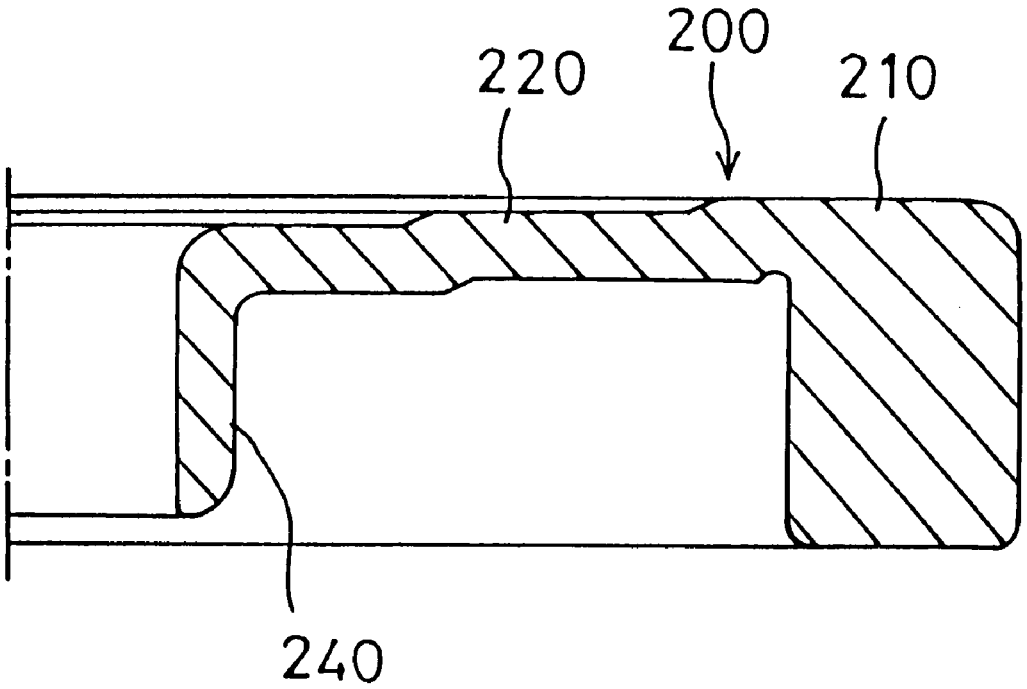
FIG. 5 is a partly sectional view of a resultant sheet metal member produced by cutting the sheet metal member obtained by the second forming step.
Figure 7:
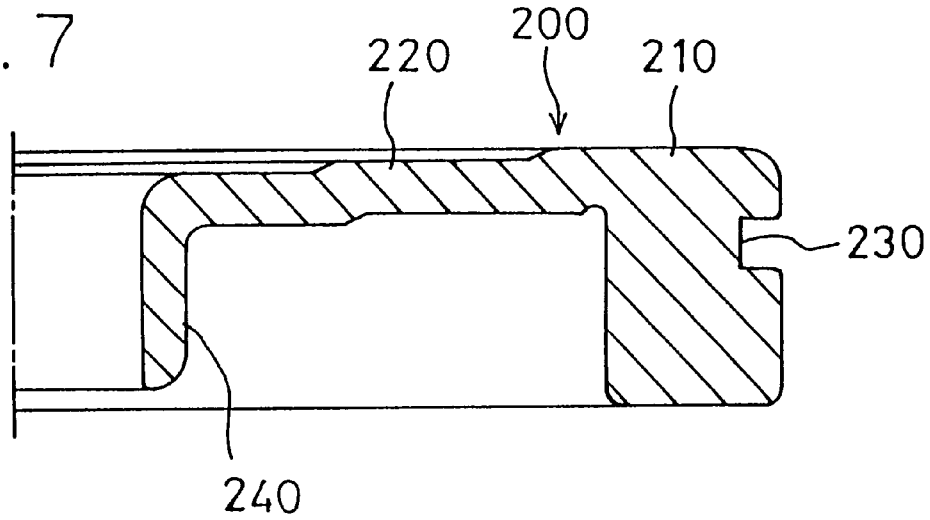
FIG. 7 is a partly sectional view of a resultant sheet metal member produced by cutting the sheet metal member obtained by the second forming step in FIG. 6.

As shown in the sheet metal member 200 illustrated in FIG. 4C and the sheet metal member 200 illustrated in FIG. 6, a necessary cutting process is applied to the sheet metal member 200 obtained by the second forming step, and an end surface of the peripheral wall 210 shown in FIGS. 5 and 7, is the horizontal sheet metal member 200. The sheet metal member 200 can be suitable for piston components, the drive plate or the like as mentioned above. Especially, in the sheet metal member 200 in FIG. 7, having the annular groove 230 disposed at the peripheral wall 210, the annular groove 230 conveniently functions as a mounting groove for mounting a piston ring.

Gears are disposed on an outer periphery and an inner periphery of the peripheral wall 210, thereby serving as an outer-teeth gear and an inner-teeth gear, and the outer periphery of the peripheral wall 210 is provided with one or more V-grooves, thereby making it possible to utilize it as a V-groove pulley. The sheet metal member 200 shown in the figure, includes a boss 240 arranged at the center of the base plate for serving as an axial hole or a fixing hole. The boss 240 can easily be disposed at the disc-shaped sheet metal member 100 by a burring process or the like applied to the disc-shaped sheet metal member 100.

In the above thickening method, the disc-shaped sheet metal member 100 having a thickness of 3.6 mm, is employed, and the radius of curvature R1 of the annular bottom surface 35 of the first forming roller 30A shown in FIG. 8 is 3.0 mm, an opening angle al between one annular surface 33 and an assumption line P crossing orthogonally an axis is 17°, an opening angle b1 between the other annular surface 34 and the assumption line P is 5°, and the opening angle between the pair of the annular surfaces 33 and 34 is 22°. The radius of curvature R2 of the annular bottom surface 35 of the first forming roller 30B as shown in FIG. 9 is 6.0 mm, an opening angle a2 between one annular surface 33 and the assumption line P crossing orthogonally the axis is 15°, an opening angle b2 between the other annular surface 34 and the assumption line P is 50, and the opening angle between the pair of annular surfaces 33 and 34 is 20°. In addition, in the second forming roller 40 shown in FIG. 9, an opening angle a3 between the annular surface 33 and the assumption line P crossing orthogonally the axis is 5°, the opening angle b2 between the other annular surface 34 and the assumption line P is 8°, and the opening angle between the pair of annular surfaces 33 and 34 is 13°.

Figure 13:
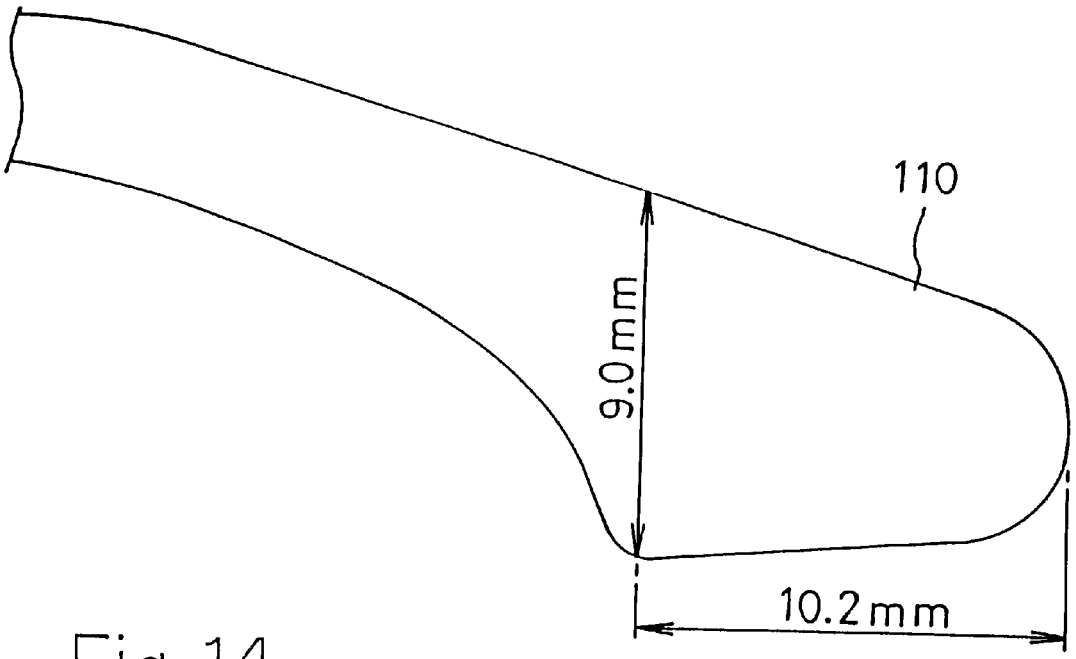
FIG. 13 is a view illustrating measurements of main parts of the disc-shaped sheet metal member in FIG. 2C.
Figure 14:
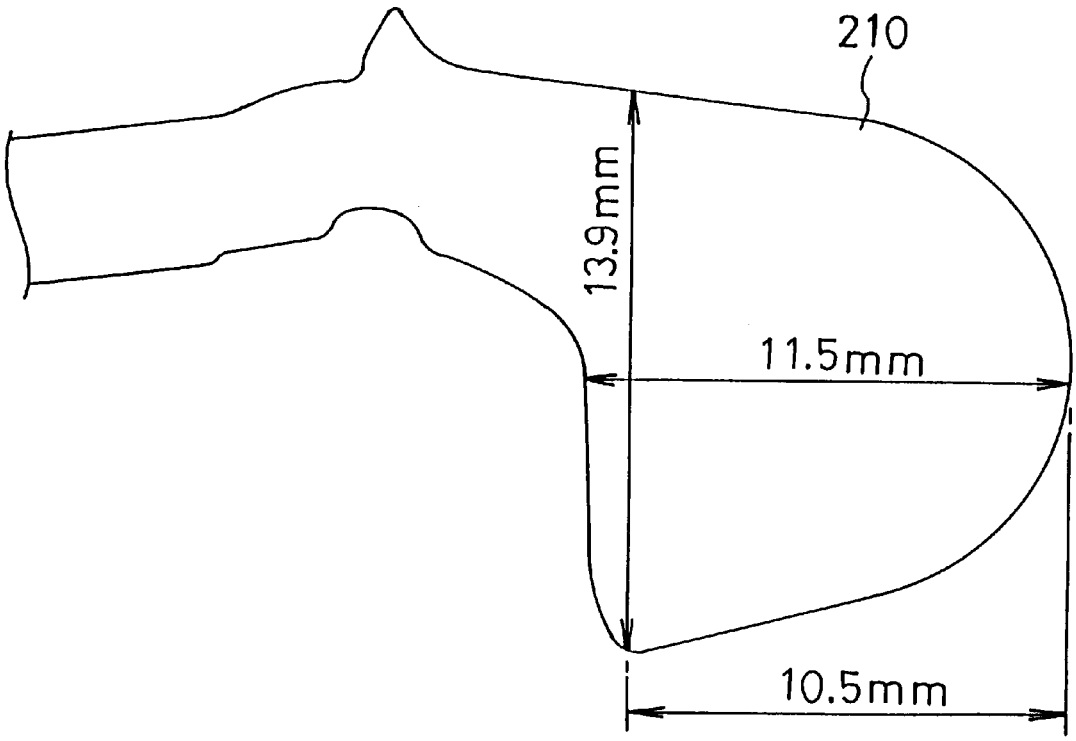
FIG. 14 is a view illustrating measurements of main parts of the disc-shaped sheet metal member in FIG. 3C.
Figure 15:
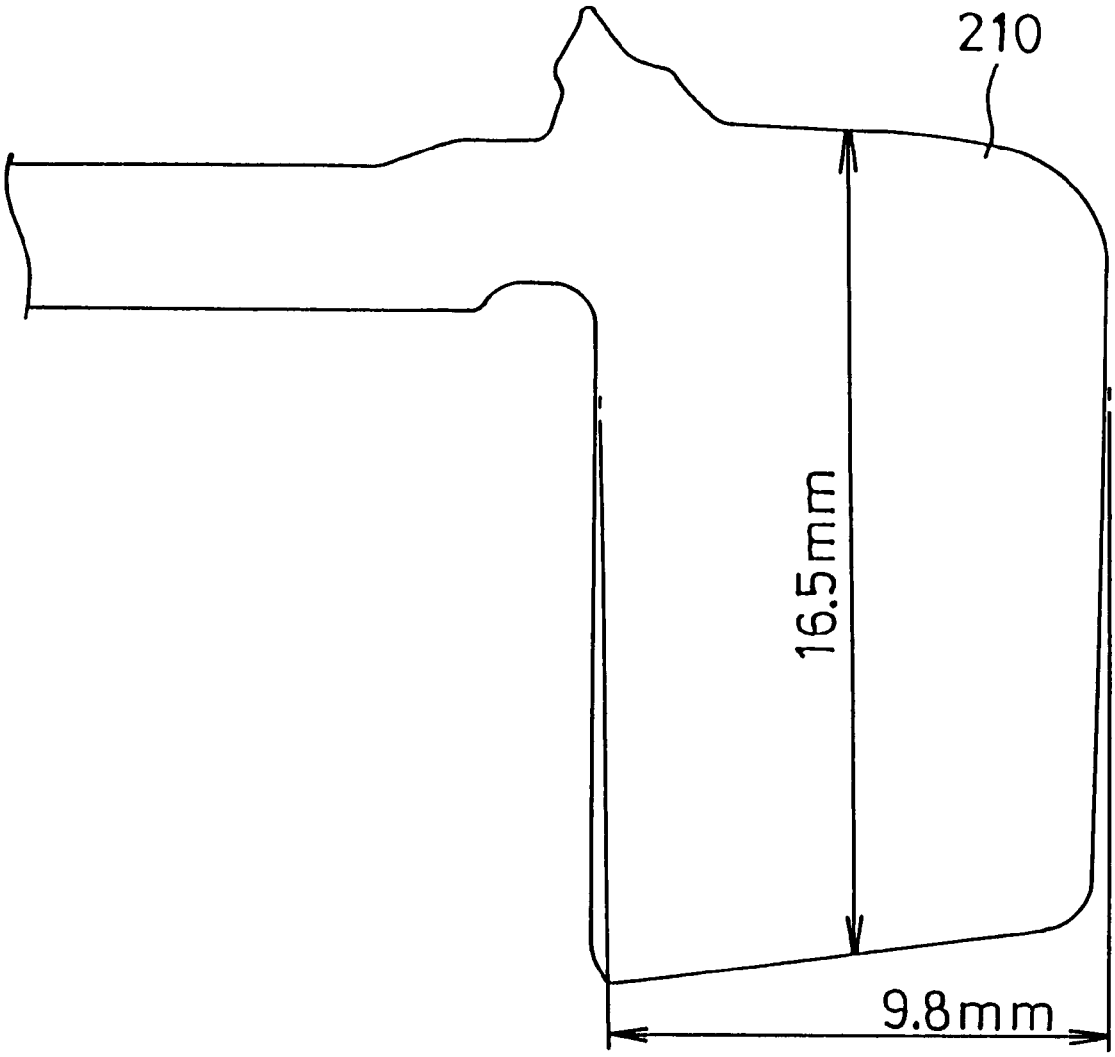
FIG. 15 is a view illustrating measurements of main parts of the disc-shaped sheet metal in FIG. 4C.

When the above thickening method is conducted by employing each forming roller, the projection 110 having measurements shown in FIG. 13 in the previous small step included in the first forming step, is formed, the peripheral wall 210 having measurements shown in FIG. 14 in the post small step, is formed, and the peripheral wall 210 having measurements shown in FIG. 15 in the second forming step is formed. The thickness of the interposed portion held between the first rotating die 10 and the second rotating die 20, or the base plate 220 corresponds to that of an original disc-shaped sheet metal material 100, i.e., 3.6 mm.

As shown in FIG. 15, the axial thickness of the peripheral wall 210 is 16.5 mm, which is substantially 5 times the thickness of the original disc-shaped sheet metal member 100 or 3.6 mm. Moreover, the radial thickness of the peripheral wall 210 is 16.5 mm, which is substantially 3 times the thickness of the original disc-shaped sheet metal member 100 or 3.6 mm.

As shown in the above description, a sheet metal member having a peripheral wall according to the present invention, comprises a circular base plate 220 and a peripheral wall 210 projecting from an outer periphery of the base plate 220 to an axial end, and the peripheral wall 210 being integrally formed with the circular base plate 220, wherein an axial thickness in the peripheral wall 210 is increased to be 4 or more times the thickness of the base plate 220, and a radial thickness of the peripheral wall 210 is increased to be 2 or more times the thickness of the base plate. It was not until the present thickening method was employed that the above sheet metal member 200 can be produced. Moreover, according to the present thickening method, the sheet metal member 200 is economical, because, in producing it, the resulting waste metal by cutting and shaving is not produced. Preferably, in practice, the axial thickness in the peripheral wall 210 is increased to be 4 to 5 times the thickness of the base plate 220 and the radial thickness in the peripheral wall 210 is increased to be 2 to 3 times the thickness of the base plate.

Though, in the above mentioned thickening method, the embodiment wherein the first forming step is divided into two small steps, is described, it may be further divided into more small steps. In FIG. 16, in the thickening method by employing the disc-shaped sheet metal material having the thickness of 3.6 mm, the first forming step is divided into five small steps, and substantial values for Rn, θ n, an, bn, illustrated in FIG. 10, of the first forming roller employed in the each small step, are shown in order of steps. Additionally, in the second forming step, the same second forming roller which is employed in the above embodiment is employed and concrete values for R3, θ 3, a3, b3 in FIG. 11 according to the second forming step are also indicated therewith in FIG. 16.

In a method of thickening a peripheral wall of a sheet metal member according to the present invention, the peripheral wall formed integrally with the base plate, has an increased axial thickness being 4 or more times the thickness of the base plate, and an increased radial thickness being 2 or more times the thickness thereof. Therefore, the present invention enables the sheet metal member, conventionally produced only by a cutting process, to be produced by a rolling process. The sheet metal member having the peripheral wall according to the present invention is suitable for the piston components, the drive plate, the pulley or the like.

What is claimed is:

1. A method of thickening a peripheral wall of a sheet metal member comprising a first forming step having plural small steps, each small step comprising a series of steps of:

holding pressingly a disc-shaped sheet metal member in an interposed state, between a first rotating die and a second rotating die;

making the disc-shaped sheet metal member rotate with a first rotating die and a second rotating die;

pressing a first forming roller having a first groove-shaped forming surface wherein a pair of annular surfaces widening outwardly are connected via a sectional-curved annular bottom surface, in a radially inward direction against an outer periphery of a projection of the disc-shaped metal sheet projecting outwardly from the interposed portion;

thickening the projection in an axial direction and a radial direction; and shaping the projection so as to fit in the groove-shaped forming surface of the first forming roller while thickening it, whereby the interposed portion is a base plate and the projection is a peripheral wall protruding axially from the outer periphery of the base plate to one side, and wherein, the first forming step is divided into said plural small steps, and, as relation between a previous small step in the first forming step and a post small step following the previous one, a radius of curvature of the annular bottom surface of the first forming roller employed in the post small step is greater than that of the first forming roller employed in the previous small step, and an opening angle made between a pair of annular surfaces of the first forming roller employed in the post small step is smaller than that between a pair of annular surfaces of the first forming roller employed in the previous small step and a depth of the first groove-shaped forming surface of the first forming roller employed in the post small step is less than that of the first groove-shaped forming surface of the first forming roller employed in the previous small step.

2. A method of thickening a peripheral wall of a sheet metal member according to claim 1, further comprising a second forming step for forming the outer peripheral surface of the peripheral wall in a cylindrical shape after conducting the first forming step, of:

pressing a second forming roller having a second groove-shaped forming surface including a pair of annular surfaces widening outwardly and an annular bottom surface being axially flat, for connecting the annular surfaces, against the peripheral wall obtained by the first forming step, thereby shaping the outer surface of the peripheral wall so as to fit in the second groove-shaped forming surface of the second forming roller.

3. A method of thickening a peripheral wall of a sheet metal member according to claim 2, further comprising: providing radially predetermined portions with annular steps to the disc-shaped sheet metal member and, wherein, the disc-shaped sheet metal member having the annular steps disposed on each radial predetermined portion is held pressingly between the first rotating die and the second rotating die, and annular steps disposed on the first rotating die and the second rotating die radially engage with the annular steps of the disc-shaped sheet metal member.

4. A method of thickening a peripheral wall of a sheet metal member according to claim 1, wherein, an initial small step among the plural small steps comprises a series of steps of:

pressing one annular surface in the first groove-shaped forming surface of the first forming roller against the outer periphery of the projection of the disc-shaped sheet metal member;

bending the projection in a state whereby the projection widens as it approaches an end;

thickening the projection axially and radially; and shaping the surface of the projection so as to fit in the first groove-shaped forming surface of the first forming roller, while thickening it.

5. A method of thickening a peripheral wall of a sheet metal member according to claim 1, wherein a radius of curvature of the annular bottom surface of the first forming roller employed in the initial small step is shorter than a thickness of the interposed portion of the disc-shaped sheet metal material.

6. A method of thickening a peripheral wall of a sheet metal member according to claim 1, wherein a radius of curvature of the annular bottom surface of the first forming roller employed in the initial small step is shorter than 1.5 times the thickness of the interposed portion of the disc-shaped sheet metal member.

7. A method of thickening a peripheral wall of a sheet metal member according to claim 1, further comprising: providing radially predetermined portions with annular steps to the disc-shaped sheet metal member, and wherein, the disc-shaped sheet metal member having the annular steps disposed on each radial predetermined portion is held pressingly between the first rotating die and the second rotating die, and annular steps disposed on the first rotating die and the second rotating die radially engage with the annular steps of the disc-shaped sheet metal member.

* * * * *

UNITED STATES PATENT AND TRADEMARK OFFICE

CERTIFICATE OF CORRECTION

PATENT NO. : 5,904,060

DATED : May 18, 1999

INVENTOR(S) : Toshiaki Kanemitsu et al

It is certified that error appears in the above-indentified patent and that said Letters Patent is hereby corrected as shown below:

Title page, item [86], the 371 date: Mar. 17, 1998 and 102(e) date: Mar. 17, 1998 should both be --Feb. 17, 1998--.

Claim 3, column 10, line 51, the "," (first occurrence) should be before "and".

Signed and Sealed this

Ninth Day of May, 2000

*Attest:*

*Attesting Officer*

Q. TODD DICKINSON

*Director of Patents and Trademarks*